US006942739B2

(12) United States Patent
Chun et al.

(10) Patent No.: US 6,942,739 B2
(45) Date of Patent: Sep. 13, 2005

(54) REACTIVE HEAT TREATMENT TO FORM PEARLITE FROM AN IRON CONTAINING ARTICLE

(75) Inventors: Changmin Chun, Lawrenceville, NJ (US); Trikur Anantharaman Ramanarayanan, Somerset, NJ (US); James Dirickson Mumford, Long Valley, NJ (US); Adnan Ozekcin, Bethlehem, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/002,576

(22) Filed: Oct. 26, 2001

(65) Prior Publication Data

US 2003/0079806 A1 May 1, 2003

(51) Int. Cl.[7] ..... C23C 8/22; C23C 8/80
(52) U.S. Cl. ..... 148/225; 148/233
(58) Field of Search ..... 148/225, 233

(56) References Cited

U.S. PATENT DOCUMENTS

| | | | | |
|---|---|---|---|---|
| 3,873,375 A | | 3/1975 | Bolen et al. | 148/12.1 |
| 4,202,710 A | * | 5/1980 | Naito et al. | 148/233 |
| 4,461,655 A | * | 7/1984 | Kerridge | 148/227 |
| 4,921,025 A | | 5/1990 | Tipton et al. | 148/16.5 |
| 5,869,195 A | * | 2/1999 | Ramanarayanan et al. | 428/610 |
| 5,997,286 A | * | 12/1999 | Hemsath et al. | 432/59 |
| 6,258,179 B1 | | 7/2001 | Takayama et al. | 148/233 |
| 6,287,393 B1 | * | 9/2001 | Garg et al. | 148/206 |

FOREIGN PATENT DOCUMENTS

| | | | | |
|---|---|---|---|---|
| JP | 02-185960 A | * | 7/1990 | C23C/4/00 |
| JP | 03-044414 A | * | 2/1991 | C21D/8/00 |
| JP | 04-337024 A | * | 11/1992 | C22C/38/40 |
| JP | 05-059427 A | * | 3/1993 | C23C/8/22 |
| JP | 05-059527 A | * | 3/1993 | C23C/8/22 |

OTHER PUBLICATIONS

Stickels, "Gas Carburizing", from ASM Handbook, vol. 4: Heat Treating, pub. by ASM International, 1995, pp. 312–324.*

* cited by examiner

*Primary Examiner*—Roy King
*Assistant Examiner*—Harry D. Wilkins, III
(74) *Attorney, Agent, or Firm*—Joseph J. Dvorak

(57) ABSTRACT

The present invention is directed to a process for producing pearlite from an iron containing article comprising the steps of, (a) heating an iron containing article comprising at least 50 wt % iron for a time and at a temperature sufficient to convert at least a portion of said iron from a ferritic structure to an austenitic structure, (b) exposing said austenitic structure, for a time sufficient and at a temperature of about 727 to about 900° C., to a carbon supersaturated environment to diffuse carbon into said austenitic structure and (c) cooling said iron containing article to form a continuous pearlite structure.

6 Claims, 4 Drawing Sheets

REACTIVE HEAT TREATMENT TO FORM PEARLITE FROM AN IRON CONTAINING ARTICLE

FIELD OF THE INVENTION

The instant invention is directed to a method for producing pearlite from an iron containing article by reactive heat treatment.

BACKGROUND OF THE INVENTION

Because it is relatively inexpensive, carbon steel is the workhorse of the petrochemical industry. Chromium alloying is known to improve the corrosion resistance of carbon steel, but chromium is an expensive element. Thus, approaches whereby corrosion resistance can be achieved without expensive alloying are desirable.

Pearlite is a microstructural constituent of steels which is made up of alternating layers of ferrite (body centered cubic iron) and cementite ($Fe_3C$). The pearlite microstructure is particularly resistant to certain forms of acid corrosion such as, for example, corrosion by organic acids. Thus, pearlite could be a ready substitute for expensive chromium alloying, however, the strength characteristics of pearlite limit its use as a bulk structural material for many applications since pearlite is produced from carbon steels containing at least 0.77% carbon.

Thus, what is needed in the art is a process for producing pearlite from an iron containing article which process preserves the mechanical properties of the article.

SUMMARY OF THE INVENTION

The present invention is directed to a process for producing pearlite from an iron containing article comprising the steps of, (a) heating an iron containing article comprising at least 50 wt % iron for a time and at a temperature sufficient to convert at least a portion of said iron from a ferritic structure to an austenitic structure, (b) exposing said austenitic structure, for a time sufficient and at a temperature of about 727 to about 900° C. to a carbon supersaturated environment to diffuse carbon into said austenitic structure and (c) cooling said iron containing article to form a continuous pearlite structure.

A carbon supersaturated environment is herein defined as an environment in which the thermodynamic activity of carbon is greater than unity. It is known that CO is the most potent carbon transferring molecule and the presence of hydrogen in carbon monoxide tends to facilitate carbon transfer. The following reactions can lead to the transfer of carbon to the metal surface from carbonaceous environments.

$$CO+H_2=C+H_2O \quad [1]$$

$$2CO=C+CO_2 \quad [2]$$

$$CH_4=C+2H_2 \quad [3]$$

Reaction [1] has the fastest kinetics: therefore CO—$H_2$ gas mixtures are the preferred gas mixtures to be used as the carbon supersaturated environments. Typical hydrogen contents in carbon monoxide can range from about 2.5 vol % to about 90 vol %, preferably about 10 vol % to about 60 vol %.

The iron articles utilized in the instant invention need not contain any carbon. It is sufficient for the carbon which forms the pearlite structure to come from the environment to which the iron article is exposed.

Figure 4:
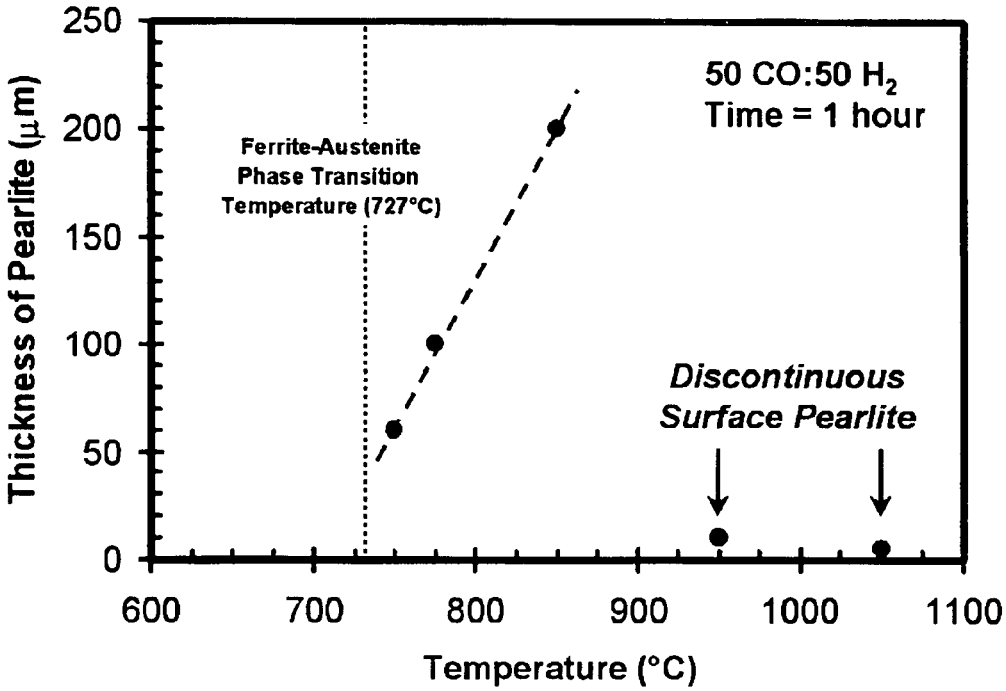
FIG. 4 depicts the thickness variation of surface pearlite formed by the method of this invention as a function of temperature in 50% CO:50% $H_2$ environment for 1 hour.

According to the instant invention, austenite is converted to a continuous pearlite layer. As shown in FIG. 4, the preferred temperature range for the conversion is about 727 to about 900° C. Above this temperature, the pearlite phase will lose its continuity and fail to provide corrosion protection.

Times and temperatures for conversion of ferritic iron to austenic iron are well known in the art.

DETAILED DESCRIPTION OF THE INVENTION

The instant invention involves exposing an iron containing article, where the iron has been converted to the austenitic state, to a carbon supersaturated gaseous environment and then cooling the article to obtain a continuous layer of pearlite. The preferred temperature range for accomplishing the conversion of austenite to pearlite is shown in FIG. 4. The preferred composition of the carbon supersaturated environment corresponds to the plateau region in FIG. 3. In this range, the reaction times are shorter to obtain a specific thickness of pearlite and therefore, gas compositions in this range are economically more attractive. The reaction times to achieve various thicknesses of continuous pearlite can be determined by reference to FIG. 2.

Figure 2:
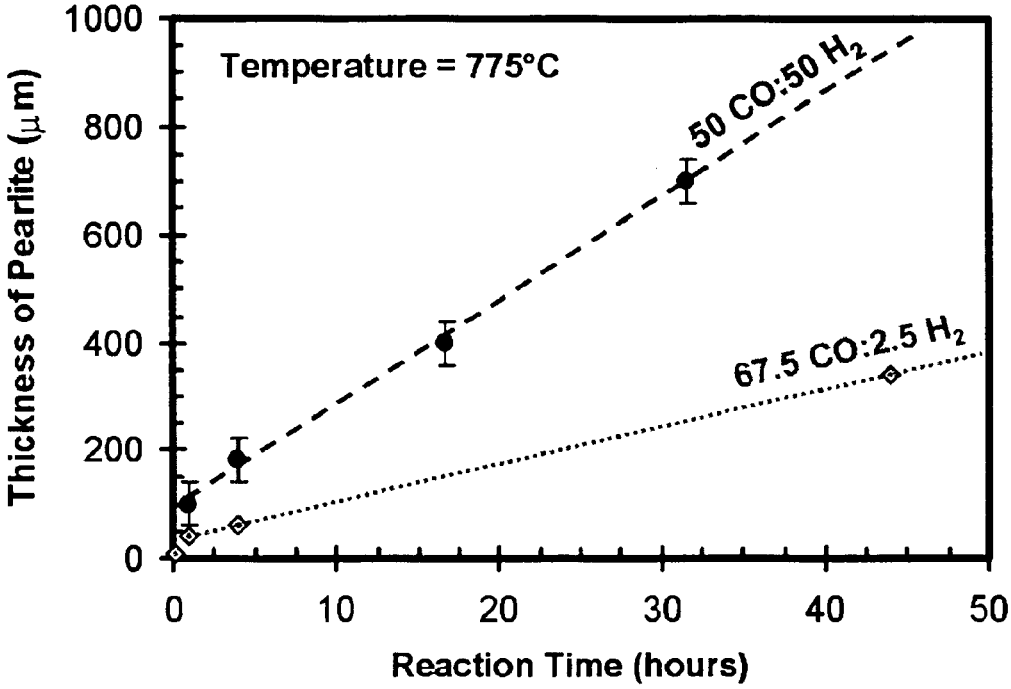
FIG. 2 depicts the thickness variation of surface pearlite formed by the method of this invention as a function of reaction time at 775° C. in 50% CO:50% $H_2$ as well as 97.5% CO:2.5% $H_2$ environments.

The process can be used to obtain any thickness of continuous pearlite. It can also be used to completely convert the iron-containing article to pearlite. Thus, the production of pearlite in the instant invention can be easily controlled to prepare a continuous layer of pearlite, or to convert all of the iron contained in the article to a continuous pearlite structure. Hence a pearlite structure can be a continuous layer of pearlite on the surface of the iron article being acted upon, or a completely converted pearlite article. The thickness of pearlitic layers can be controlled by the carbon supersaturated environment, the temperature and the exposure time. Such exposure times are readily determinable by the skilled artisan, as depicted in FIG. 2.

Figure 3:
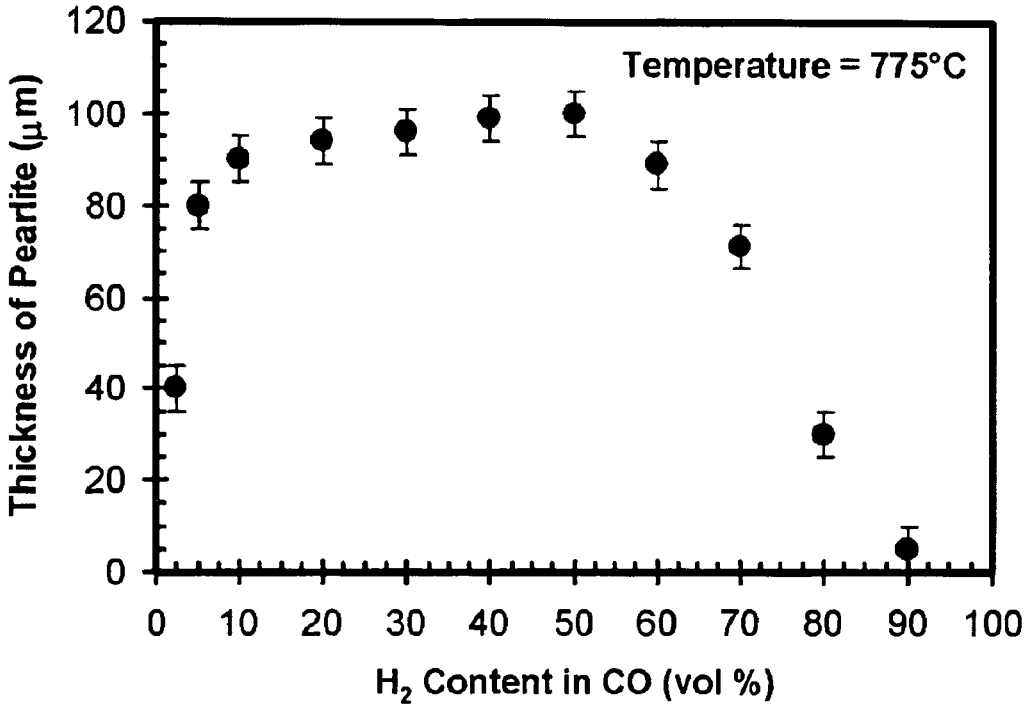
FIG. 3 depicts the thickness variation of surface pearlite formed by the method of this invention as a function of $H_2$ content in CO at 775° C. for 1hour.

Shown in FIG. 3 are results for the thickness variation of surface pearlite formed on pure iron after reactive heat treatment at 775° C. for 1 hour as a fuction of the composition of carbon supersaturated gas mixtures. Maximum thickness of surface pearlite was obtained in a specific range of CO—$H_2$ gas composition. Typical hydrogen contents in carbon monoxide can range from about 2.5 vol % to about 90 vol %, preferably about 10 vol % to about 60 vol %.

The thickness of the pearlite layer can be any thickness desired. All that is necessary is to alter the exposure time to the carbon supersaturated gaseous environment at the noted temperatures. For thinner layers, the exposure time will be less, and for thicker layers the exposure time will be greater. Typical exposure times can range from about 1 minute to about 50 hours, preferably from about 5 minutes to about 25 hours, and most preferably from about 10 minutes to about 10 hours. Thus, the exposure time and temperature will be those necessary to form a desired thickness of pearlite following step (c). It is important to note that the entire iron containing article can be converted to pearlite if desired in which case the thickness of the article will be the desired thickness.

Typical layer or structure thickness will thus range from at least about 10 microns up to the thickness of the iron article being acted on, preferably from about 10 to about 1000 microns, more preferably from about 10to about 500 microns.

When converting the iron containing article from the ferritic crystal structure to the austenitic crystal structure, all that is necessary is for the article to be heated. One skilled in the art can easily determine the time and temperature necessary to accomplish such crystal structure conversion by reference to any published Fe—C phase diagram (See for example: ASM Specialty Handbook, Carbon and Alloy Steels, Ed., by J. R. Davis, p.366 (1996) ASM International).

The cooling step (c) will determine the lamellar spacing of the pearlite formed. The cooling rate for a desired coarseness, or lamellar spacing, of the pearlite is easily determined by the skilled artisan taking into account the pearlite formation temperature, cooling rate and iron containing article composition.

The iron containing article to be acted upon will contain at least about 50 wt % iron. The article can be composed entirely of iron. The amount of carbon contained in the article can range from less than 0.77 wt % down to 0 wt % carbon. Thus, the instant invention allows the skilled artisan to prepare pearlite from an iron containing article with much better mechanical properties than carbon steels containing 0.77 wt % or more carbon. The iron containing article may further comprise other components including, but not limited to chromium, silicon and manganese. All that is necessary for the instant invention is that the article being acted upon contains at least about 50 wt % iron.

Additionally, an article already having an amount of pearlite in combination with ferrite, can be subjected to the instant invention to convert the ferrite to pearlite.

The carbon supersaturated environment to which the iron containing article is exposed is any carbon supersaturated environment. The thermodynamic carbon activity in the supersaturated environment is greater than 1. Examples of suitable environments include, but are not limited to CO, $CH_4$, or other hydrocarbon gases, such as propane ($C_3H_8$) and mixtures thereof with $H_2$,$O_2$,$N_2$,$CO_2$, and $H_2O$.

The instant invention allows the skilled artisan to produce steels having both corrosion resistance and mechanical properties far superior to those of carbon steels containing 0.77 wt % or more carbon. This is because the steel's mechanical properties improve as the carbon content decreases. In the instant invention, the amount of carbon diffused into the iron containing article from the carbon supersaturated environment is utilized to produce pearlite. The portion of the iron containing article not converted to pearlite, is unchanged and maintains the mechanical properties it possessed prior to treatment in accordance with the instant invention. Thus, for example, the amount of carbon necessary to form a pearlite layer of desired thickness can be diffused into the iron containing article thus forming pearlite. The mechanical properties of the remaining non-pearlitic portion of the article will be unchanged.

The following examples are illustrative and are not meant to be limiting in any way.

EXAMPLE 1

Figure 1:
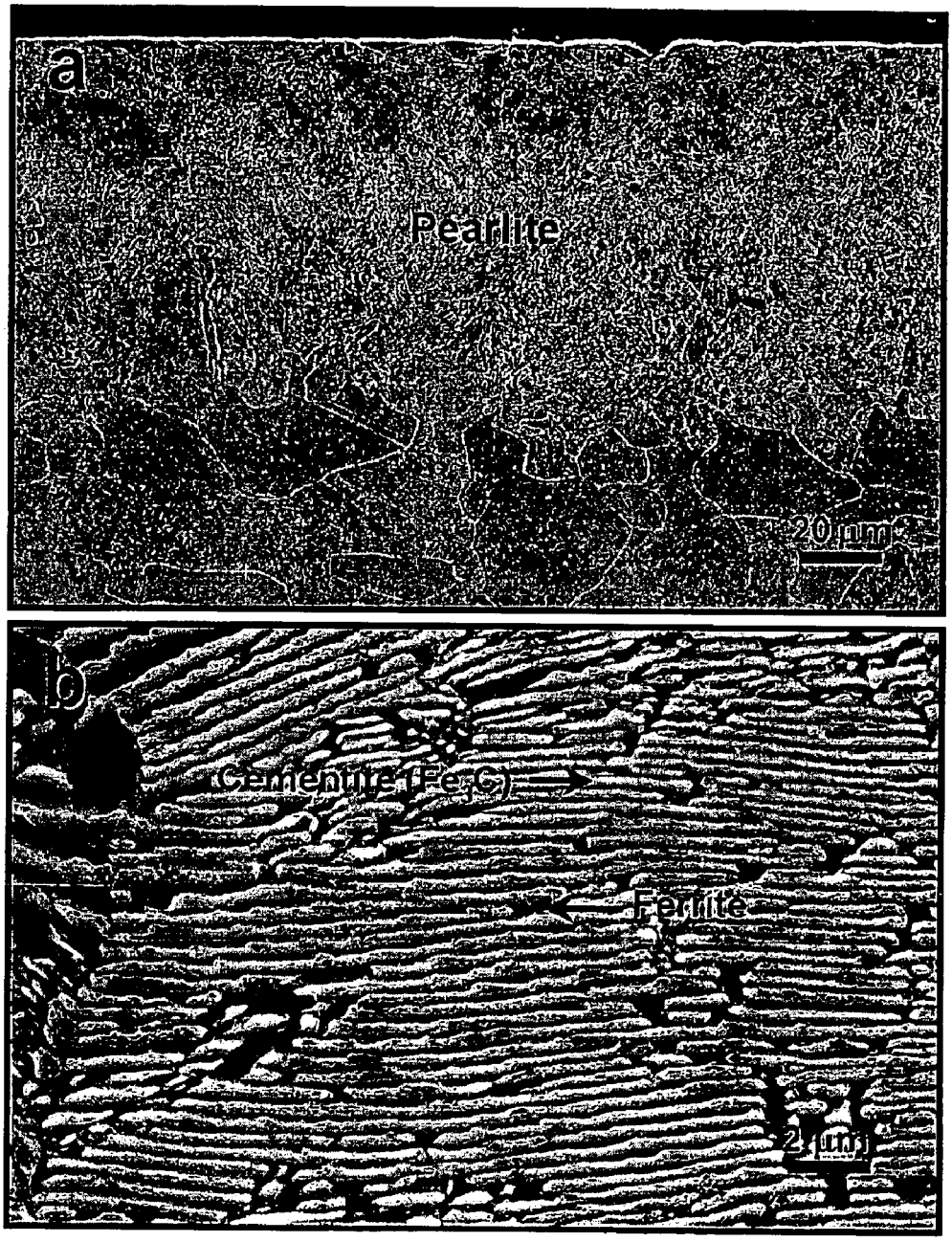
FIG. 1 depicts scanning electron micrographs showing (a) surface pearlitic structure on pure iron after reactive heat treatnent at 775° C. for 1 hour in 50% CO:50% $H_2$ environment and (b) enlarged area on surface revealing the ferrite (Fe) and cementite ($Fe_3C$) forming as roughly parallel lamellae, or platelets, to produce a composite lamellar two-phase structure. In this scanning electron micrograph the cementite lamellae appear light and the ferrite appears recessed, because it has etched more deeply than the cementite. These figures show the final product having the pearlite surface, which is produced in accordance with this invention.

Iron of 99.99% purity is heated to a temperature of 775° C. in a hydrogen environment in a vertical quartz reactor tube and held at that temperature for ~5 minutes. Thereupon, the environment is changed to 50% CO-50% $H_2$. After 1 hour of exposure, the metal sample is cooled by lowering the furnace surrounding the quartz reactor. After the sample has attained room temperature, the surface microstructure is examined by scanning electron microscopy. FIG. 1*a* reveals that a pearlite surface layer of 100 micron thickness has formed on the iron surface. A magnified view of the pearlite microstructure, showing alternating layers of ferrite and cementite, is depicted in FIG. 1*b*. By changing the duration of exposure to the carbon supersaturated gaseous environment. the thickness of the pearlite layer can be changed. This is shown by the graph in FIG. 2.

What is claimed is:

1. A process for producing pearlite from an iron containing article having less than 0.77 wt % carbon consisting of the steps of, (a) heating an iron containing article comprising at least 50wt % iron and in which the amount of carbon contained in the article is less than 0.77 wt % down to 0.0 wt % carbon in a non-carburizing atmosphere for a time and at a temperature sufficient to convert at least a portion of said article from a ferritic structure to an austenitic structure, (b) thereafter exposing said austenitic structure, for a time sufficient and at a temperture of about 727 to about 900° C., to a carbon supersaturated CO/$H_2$ environment consisting essentially of CO and 10 to 50 vol. % $H_2$, and having a carbon activity greater than about 1, to disffuse carbon into said austenitic structure and (c) cooling said iron containing article to form a continuous pearlite structure.

2. The process of claim 1 wherein said iron containing article further comprises silicon, manganese, and mixtures thereof.

3. The process of claim 1 wherein said time sufficient to diffuse carbon into the austenic structure ranges from about 1 minute to about 50 hours.

4. The process of claim 3 wherein said pearlite structure is a continuoous layer having thickness of at least about 10 microns.

5. The process of claim 4 wherein the layer is from about 10 microns to about 1000 microns.

6. The process of claim 3 wherein the pearlite structure has a thickness equal to the iron article.

* * * * *